US010139785B2

(12) United States Patent
Mao

(10) Patent No.: US 10,139,785 B2
(45) Date of Patent: Nov. 27, 2018

(54) SMART WATCH

(71) Applicant: BOE Technology Group Co., Ltd., Beijing (CN)

(72) Inventor: Defeng Mao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 39 days.

(21) Appl. No.: 15/325,165

(22) PCT Filed: Feb. 24, 2016

(86) PCT No.: PCT/CN2016/074413

§ 371 (c)(1),
(2) Date: Jan. 10, 2017

(87) PCT Pub. No.: WO2017/041446

PCT Pub. Date: Mar. 16, 2017

(65) Prior Publication Data

US 2017/0205774 A1 Jul. 20, 2017

(30) Foreign Application Priority Data

Sep. 11, 2015 (CN) ..... 2015 1 0580559

(51) Int. Cl.
*G04G 19/10* (2006.01)
*G04C 10/00* (2006.01)
(Continued)

(52) U.S. Cl.
CPC ..... *G04G 19/10* (2013.01); *A44C 5/0007* (2013.01); *A44C 5/0053* (2013.01); *G04C 10/00* (2013.01);
(Continued)

(58) Field of Classification Search
CPC ..... G04G 19/10; G04G 21/08; G04G 17/083; G04C 10/02; G04C 10/00
(Continued)

(56) References Cited

U.S. PATENT DOCUMENTS 3,971,206 A 7/1976 Martino
5,695,885 A 12/1997 Malhi
(Continued)

FOREIGN PATENT DOCUMENTS

CN 2585289 Y 11/2003
CN 2836351 Y 11/2006
(Continued)

OTHER PUBLICATIONS

Fourth Office Action for Chinese Patent Application No. 201510580559.0, dated Oct. 25, 2017, 13 pages.
(Continued)

*Primary Examiner* — Edwin A. Leon
(74) *Attorney, Agent, or Firm* — Westman, Champlin & Koehler, P.A.

(57) ABSTRACT

The present disclosure relates to a smart watch including a watch dial. The smart watch further include: a battery provided in a watch frame of the watch dial to supply electric power to a circuit in the watch dial. According to the present disclosure, by providing batteries in the watch frame and the watchband of the smart watch, spaces occupied by the watch frame and the watchband may be sufficiently utilized to increase total electricity storage capacity of the smart watch such that the smart watch has a prolonged standby time.

12 Claims, 2 Drawing Sheets

(51) Int. Cl.

| | |
|---|---|
| ***G04G 19/00*** | (2006.01) |
| ***G04C 10/02*** | (2006.01) |
| ***G04G 21/08*** | (2010.01) |
| ***A44C 5/00*** | (2006.01) |

(52) U.S. Cl.
CPC ..... *G04C 10/02* (2013.01); *G04G 19/00* (2013.01); *G04G 21/08* (2013.01)

(58) Field of Classification Search
USPC ..... 368/282, 203–204, 281
See application file for complete search history.

(56) References Cited

U.S. PATENT DOCUMENTS

| | | | | |
|---|---|---|---|---|
| 5,889,737 | A | 3/1999 | Alameh et al. | |
| 9,798,356 | B2 * | 10/2017 | Nakayama | G06F 1/163 |
| 2013/0258821 | A1 * | 10/2013 | Ohiso | G04C 10/02 368/205 |

FOREIGN PATENT DOCUMENTS

| | | | |
|---|---|---|---|
| CN | 2865004 | Y | 1/2007 |
| CN | 102736505 | A | 10/2012 |
| CN | 202563251 | U | 11/2012 |
| CN | 202710943 | U | 1/2013 |
| CN | 103984223 | A | 8/2014 |
| CN | 104345632 | A | 2/2015 |
| CN | 204302663 | U | 4/2015 |
| CN | 204302674 | U | 4/2015 |
| CN | 104617618 | A | 5/2015 |
| CN | 204360103 | U | 5/2015 |
| CN | 204422983 | U | 6/2015 |
| CN | 104767269 | A | 7/2015 |
| CN | 104898407 | A | 9/2015 |
| CN | 105045081 | A | 11/2015 |
| CN | 204925647 | U | 12/2015 |
| JP | 4593072 | B2 | 12/2010 |

OTHER PUBLICATIONS

First Office Action, including Search Report, for Chinese Patent Application No. 201510580559.0, dated Dec. 28, 2016, 11 pages.
Second Office Action for Chinese Patent Application No. 201510580559.0, dated Mar. 13, 2017, 10 pages.
International Search Report and Written Opinion of International Application No. PCT/CN2016/074413, dated Jun. 7, 2016, 10 pages.
English translation of Box No. V of the Written Opinion for the International Searching Authority for International Application No. PCT/CN2016/074413, 2 pages.
Third Office Action from Chinese Patent Application No. 201510580559.0, dated Jun. 23, 2017, 12 pages.

* cited by examiner

SMART WATCH

CROSS-REFERENCE TO RELATED APPLICATION

This application is a 371 National Stage Application of International Application No. PCT/CN2016/074413, filed on Feb. 24, 2016, and claims priority to Chinese Patent Application No. 201510580559.0 filed on Sep. 11, 2015 in the State Intellectual Property Office of China, the disclosures of which are incorporated herein by reference in their entirety.

BACKGROUND

1. Technical Field

Embodiments of the present invention relate to the field of smart device, and particularly to a smart watch.

2. Description of the Related Art

In prior art, smart wearable devices have been considerably widely used. Functions integrated in the smart devices are becoming diversiform and the smart devices are gradually becoming necessary product in human daily life.

However, the smart wearable devices in prior art have a markedly insufficient standby time. As an example, a smart watch basically needs to be charged once a day, and even needs to be charged once per several hours when frequently used, which brings notable inconvenience to an user and falls short of original intention of the smart wearable device for providing convenience to human living.

SUMMARY

Embodiments of the present invention may at least increase service time of battery of a smart watch.

Embodiments of the present invention provide a smart watch comprising a watch dial, wherein the smart watch further includes:

a battery provided in a watch frame of the watch dial to supply electric power to a circuit in the watch dial.

In an embodiment, the battery has a shape corresponding to a shape of the watch frame.

In an embodiment, the battery comprises a plurality of sub-batteries that are evenly distributed in the watch frame and adjacent sub-batteries are electrically connected to each other by a wire in the watch frame.

In an embodiment, the smart watch further comprises:

a watchband;

a stand-by battery provided in the watchband and electrically connected with the watch dial for supplying electric power to the circuit in the watch dial.

In an embodiment, the watchband is made of a flexible material and the stand-by battery is a flexible battery.

In an embodiment, the watchband is made of a flexible transparent material and the stand-by battery is a flexible solar battery.

In an embodiment, the watchband comprises a plurality of block-shaped units and four connection units, two parts of the watchband respectively extend outwards from opposite sides of the circumference of the watch dial and the four connection units are respectively configured as two pairs of connection units at the opposite sides of the watch dial, wherein multiple ones of the plurality of block-shaped units which ware located at a same side of the watch dial are configured between a pair of the connection units located at the same side of the watch dial as the multiple ones, and the stand-by battery comprises a plurality of stand-by sub-batteries, each stand-by sub-battery being provided in a corresponding one of the plurality of block-shaped units, and adjacent stand-by sub-batteries being electrically connected to each other by the wire configured in the connection unit.

In an embodiment, at one side of the opposite sides of the watch dial, a first stand-by sub-battery is located between a second stand-by sub-battery and a third stand-by sub-battery such that the second stand-by sub-battery is located at one side of the first stand-by sub-battery and the third stand-by sub-battery is located on the other side of the first stand-by sub-battery, and the first, second and third stand-by sub-batteries are located between a pair of the connection units and are connected together by the pair of connection units, wherein a wire which connects a first electrode of the first stand-by sub-battery with a second electrode of the second stand-by sub-battery is disposed in one connection unit of the pair of connection units and a wire which connects a second electrode of the first stand-by sub-battery with a first electrode of the third stand-by sub-battery is disposed in the other connection unit of the pair of connection units.

In an embodiment, the smart watch further includes:

a plurality of sensor units which are respectively configured in a corresponding one of the block-shaped units to sense a pressure;

a process unit configured to generate a control instruction for controlling the smart watch according to position information of the block-shaped unit where the sensor unit that had sensed the pressure is located.

In an embodiment, the smart watch further includes:

an energy transformation unit configured to sense motion and transform the energy generated by the sensed motion into electrical energy and store the electric energy in the battery.

BRIEF DESCRIPTION OF THE DRAWINGS

Features and advantages of the present invention will be understood more clearly with reference to accompanying drawings. The accompanying drawings are illustrative, but are not intended to limit the present invention in any way. In the drawings.

DETAILED DESCRIPTION OF THE EMBODIMENTS

In order to more clearly understand the objects, features and advantages of the present disclosure, a further detailed description on the present disclosure with reference to embodiments of the present invention taken in conjunction with the accompanying drawings. It is noted that the embodiments and features in the embodiments of the present application may be combined with each other without conflict.

Much specific detail of the present disclosure is described as below to sufficiently understand the present invention. The present invention may, however, be implemented in others way than the embodiments herein. Thus, the protective scope of the present invention is not limited by the embodiments that will be disclosed in below content.

Figure 1:
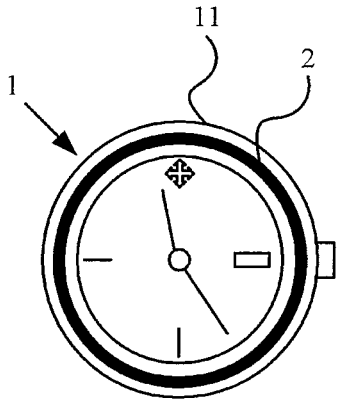
FIG. 1 is a structural schematic view of a smart watch according to an embodiment of the present disclosure.

As shown in FIG. 1, a smart watch according to an embodiment of the present invention includes a watch dial 1 including a watch frame 11, and further include a battery 2 disposed in the watch frame 11 of the watch dial 1 and configured to supply electric power to a circuit in the watch dial.

Space where the watch frame 11 occupies may be sufficiently utilized by providing the battery in the watch frame 11 of the watch dial 1, thereby increasing the whole electricity storage capacity of the smart watch and thus increasing stand-by time of the smart watch. It is noted that the watch dial 1 is described to include the watch frame 11 in the above context, and however, the watch frame 11 may be described to be included in the watch. That is, the watch may be described to include the watch frame 11 and the watch dial 1. From the drawings of the present disclosure, it is clear that the watch frame 11 is disposed peripheral of the watch dial 1, and the watch frame 11 and the watch dial 1 are both components of the watch.

In an embodiment, the shape of the battery 2 is configured to correspond to that of the watch frame 11. In an embodiment, the battery 2 may be configured to be larger to some extent, so as to sufficiently utilize the space where the watch frame 11 occupies to store more electricity. A width of the battery 2 is configured according to requirements. For example, the width of the battery 2 may be close to a width of the watch frame 11, or may be just equal to half of the width of the watch frame. The shape of the battery 2 may be configured depending on the shape of the watch frame 11. FIG. 1 merely illustrates an embodiment where the watch frame 11 is in a round annulus shape, and thus the battery 2 is also in a round annulus shape. If the watch frame 11 is in a rectangular annulus shape, the battery 2 will be also in a rectangular annulus shape.

Figure 2:
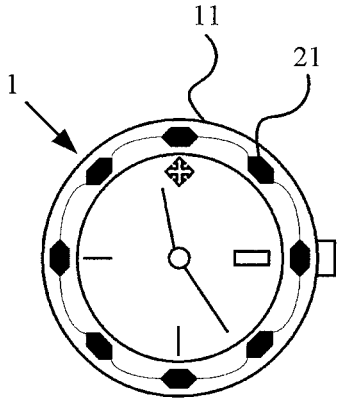
FIG. 2 is a structural schematic view of a smart watch according to an another embodiment of the present disclosure.

As shown in FIG. 2, in an embodiment, the battery 2 may include a plurality of sub-batteries 21, the plurality of sub-batteries 21 being evenly distributed in the watch frame and adjacent sub-batteries 21 being electrically connected to each other by a wire in the watch frame.

In an embodiment, the batteries 2 are discretely disposed in the watch frame 11 so as to reduce a weight of the watch dial 1 for portability.

Figure 3:
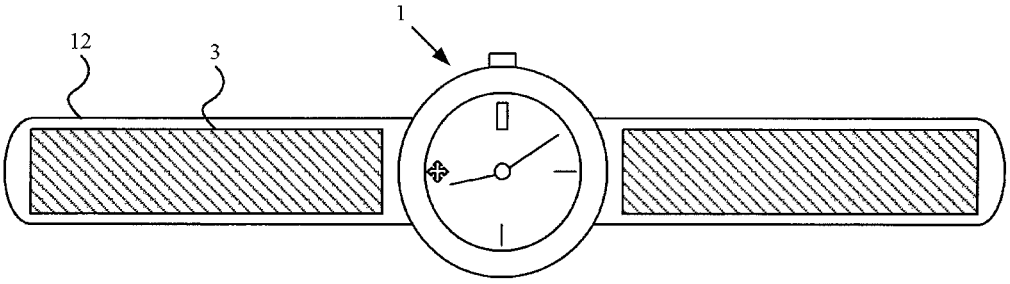
FIG. 3 is a structural schematic view of a smart watch according to a further embodiment of the present disclosure.

As shown in FIG. 3, in an embodiment, in addition to the battery 21 in the watch frame 11, the smart watch further includes:

a watchband 12;

a stand-by battery 3 arranged in the watchband 12 and electrically connected to the watch dial 1 for supplying electric power to the circuit in the watch dial 1.

Figure 4:
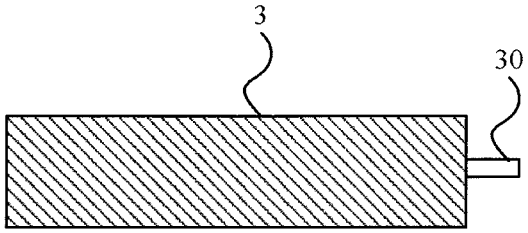
FIG. 4 is a structural schematic view of a stand-by battery according to a still embodiment of the present disclosure.

In an embodiment, the stand-by battery 3 may be further arranged in the watchband 12 to sufficiently utilize the space occupied by the watchband 12. By configuring the stand-by battery 3 to provide electric power to the watch dial 1, the stand-by time of the smart watch may be further increased. In an embodiment, the stand-by battery 3 may be film-shaped to minimize the space occupied by the stand-by battery 3. As shown in FIG. 4, the stand-by battery 3 may provide electric power to the circuit in the watch dial 1 by inserting a pin 30 thereof into the watch dial 1.

In an embodiment, the watchband 12 may be made of a flexible material and the stand-by battery 3 may be a flexible battery.

The flexible battery may be bent together with the watchband 12 to increase applicability of the stand-by battery 3. The flexible battery may include a polyimide circuit board and a solid or liquid electrolyte.

In an embodiment, the watchband 12 may be made of a transparent flexible material and the stand-by battery 3 may be a flexible solar battery.

As ambient light may be transmitted into inside of the transparent watchband 12, the flexible solar battery in the watchband 12 may be charged, thereby increasing the battery life of the stand-by battery 3. In an example, the flexible solar battery may be made of an amorphous silicon material, including for example three layers of amorphous silicon materials, in which a top layer is made of amorphous silicon (α—Si) with a bandgap of 1.8 eV to absorb blue light, an intermediate layer is made of silicon germanium alloy (α—SiGe, with a Ge content of 10%-15%) with a bandgap of 1.6 eV to absorb green light, and a bottom layer is made of silicon germanium alloy (α—SiGe, with a high Ge content) with a bandgap of 1.4 eV to absorb red light and infrared light. Further, the flexible solar battery may be provided with a reflective layer made of Al/ZnO at bottom thereof to reflect light that is not absorbed, such that the above layered structure may absorb light repeatedly, increasing generating capacity.

Figure 5:
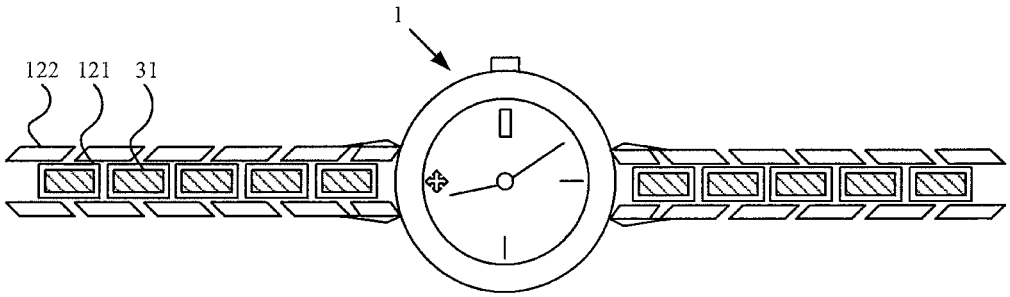
FIG. 5 is a structural schematic view of a smart watch according to a still further embodiment of the present disclosure.

As shown in FIG. 5, in an embodiment, the watchbands 12 include a plurality of block-shaped units 121 and four connection units 122. Two parts of the watchband 12 extend from opposite sides of the circumference of the watch dial 1 respectively. The four connection units may be configured as two pairs of connection units each located at the opposite sides of the watch dial respectively, each pair including an upper connection unit and a lower connection unit. A plurality of block-shaped units 121 located at a same side of the watch dial are disposed between the pair of (upper and lower) connection units that are located at the same side of the watch dial as the plurality of block-shaped units 121. It is understood that the orientation wordings such as "upper" and "lower" are exemplary, instead of be limitative to the actual locations of the watchband and other components. For example, orientation terms used herein, including "upper" and "lower" are directed to context where the watch is placed as illustrated in FIG. 5. Other orientation terms may be used for respective components of the watch depending on the placement of the watch.

The stand-by battery 3 may include a plurality of stand-by sub-batteries 31, which are each disposed in respective block-shaped units 121. Adjacent stand-by sub-batteries 31 are electrically connected by a wire provided within the connection unit 122.

When the watchband 12 is composed of a plurality of block-shaped units 121 that are connected by the connection units 122, the stand-by sub-batteries 31 may be disposed in one or more of the plurality of block-shaped units 121 and be electrically connected by the wires within the block-shaped units 121 and the connection unit 122, so as to supply electric power to the circuit of the watch dial 1. In an embodiment, sizes of the stand-by sub-batteries 31 may be set according to sizes of the block shaped units 121.

In an embodiment, at one of opposites sides of the watch dial, a first stand-by sub-battery is located between a second stand-by sub-battery and a third stand-by sub-battery such that the second stand-by sub-battery is located at one side of the first stand-by sub-battery and the third stand-by sub-battery is located on the other side of the first stand-by sub-battery. The first, second and third stand-by sub-batteries are located between a pair of connection units and are connected together by the pair of connection units. A wire which connects a first electrode of the first stand-by sub-battery with a second electrode of the second stand-by sub-battery is disposed in one connection unit 122 of the pair of connection units, and a wire which connects a second electrode of the first stand-by sub-battery with a first electrode of the third stand-by sub-battery is disposed in the other connection unit 122 of the pair of connection units.

With the configuration of the wires in the embodiments, a plurality of stand-by sub-batteries 31 may be connected in series. For example, a positive electrode of the first stand-by sub-battery is connected with a negative electrode of the second stand-by sub-battery, which is located at left side of the first stand-by sub-battery, by the wire that is located in the upper connection unit 122 located above the first stand-by sub-battery, and a negative electrode of the first stand-by sub-battery is connected with a positive electrode of the third stand-by sub-battery, which is located at right side of the first stand-by sub-battery, by the wire that is located in the lower connection unit 122 located below the first stand-by sub-battery, so as to ensure the first stand-by sub-battery, the second stand-by sub-battery and the third stand-by sub-battery are connected together in series in "S" manner in the plane of paper as shown in FIG. 5. The mentioned connection relationship is simple and easy to be configured, and is applicable to situations where more stand-by sub-batteries 31 are used.

In an embodiment, the smart watch may further include:

a plurality of sensor units, each of which is provided in corresponding one of the block-shaped units 121 to sense a pressure; and a process unit configured to generate a control instruction for controlling the smart watch according to position information of the block-shaped unit 121 where the sensor unit that has sensed the pressure is located.

Specifically, for either side of the opposite sides of the watch dial, as the block shaped units 121 in a same side of the watch dial are spaced apart from the watch dial by different distances, i.e., are located at positions of the watchband which are spaced apart from the watch dial by different distances. As such, the smart watch may be controlled by performing operation to different block shaped units 121. For example, pressing one of the block shaped units 121 that is closest to the watch dial may turn on the smart watch; pressing one of the block shaped units 121 that is furthest away from the watch dial may turn off the smart watch.

In an embodiment, in addition to the above components that are optionally included, the smart watch may further include:

an energy transformation unit configured to sense a motion and transform the energy of the sensed motion into electric energy and store it in the batteries.

A smart watch is commonly worn by a human body, thus the smart watch will be moved together with the motion of the human body and the energy transformation unit may transform the energy of the motion into electric energy and store it in the battery 2 and/or in stand-by battery 3 to prolong usage duration of the battery and thus further increase the battery lift of the smart watch.

In this description, wordings such as "first", "second" and "third" are merely used for illustration, instead of indicating or hinting a relative importance. The wordings of "a plurality of" are directed to two or more, unless definite limitations were given.

Obviously, the above embodiments are merely preferred embodiments of the present invention, but are not intended to limit the present invention. Various changes and modifications can be made by those skilled in the art. Any modification, equally replacement and development made within the spirit and scope of the present invention shall be included in the protective scope of the present invention.

The invention claimed is:

1. A smart watch comprising a watch dial, wherein the smart watch further comprises:

a battery provided in a watch frame of the watch dial to supply electric power to a circuit in the watch dial;

a watchband; and a stand-by battery provided in the watchband and electrically connected with the watch dial for supplying electric power to the circuit in the watch dial;

wherein the watchband comprises a plurality of block-shaped units and four connection units, two parts of the watchband respectively extend outwards from opposite sides of the circumference of the watch dial and the four connection units are respectively configured as two pairs of connection units at the opposite sides of the watch dial, wherein multiple ones of the plurality of block-shaped units which ware located at a same side of the watch dial are configured between a pair of the connection units located at the same side of the watch dial as the multiple ones, and the stand-by battery comprises a plurality of stand-by sub-batteries, each stand-by sub-battery being provided in a corresponding one of the plurality of block-shaped units, and adjacent stand-by sub-batteries being electrically connected to each other by the wire configured in the connection unit.

2. The smart watch according to claim 1, wherein the battery has a shape corresponding to a shape of the watch frame.

3. The smart watch according to claim 1, wherein the battery comprises a plurality of sub-batteries that are evenly distributed in the watch frame and adjacent sub-batteries are electrically connected to each other by a wire in the watch frame.

4. The smart watch according to claim 1, wherein the watchband is made of a flexible material and the stand-by battery is a flexible battery.

5. The smart watch according to claim 4, wherein the watchband is made of a flexible transparent material and the stand-by battery is a flexible solar battery.

6. The smart watch according to claim 1, wherein at one side of the opposite sides of the watch dial, a first stand-by sub-battery is located between a second stand-by sub-battery and a third stand-by sub-battery such that the second stand-by sub-battery is located at one side of the first stand-by sub-battery and the third stand-by sub-battery is located on the other side of the first stand-by sub-battery, and the first, second and third stand-by sub-batteries are located between a pair of the connection units and are connected together by the pair of connection units, wherein a wire which connects a first electrode of the first stand-by sub-battery with a second electrode of the second stand-by sub-battery is disposed in one connection unit of the pair of connection units and a wire which connects a second electrode of the first stand-by sub-battery with a first electrode of the third stand-by sub-battery is disposed in the other connection unit of the pair of connection units.

7. The smart watch according to claim 1, wherein the smart watch further comprises:

a plurality of sensor units which are respectively configured in a corresponding one of the block-shaped units to sense a pressure;

a process unit configured to generate a control instruction for controlling the smart watch according to position information of the block-shaped unit where the sensor unit that had sensed the pressure is located.

8. The smart watch according to claim 1, wherein the smart watch further comprises:

an energy transformation unit configured to sense motion and transform the energy generated by the sensed motion into electrical energy and store the electric energy in the battery.

9. The smart watch according to claim 5, wherein the watchband comprises a plurality of block-shaped units and four connection units, two parts of the watchband respectively extend outwards from opposite sides of the circumference of the watch dial and the four connection units are respectively configured as two pairs of connection units at the opposite sides of the watch dial, wherein multiple ones of the plurality of block-shaped units which ware located at a same side of the watch dial are configured between a pair of the connection units located at the same side of the watch dial as the multiple ones, and the stand-by battery comprises a plurality of stand-by sub-batteries, each stand-by sub-battery being provided in a corresponding one of the plurality of block-shaped units, and adjacent stand-by sub-batteries being electrically connected to each other by the wire configured in the connection unit.

10. The smart watch according to claim 9, wherein the smart watch further comprises:

a plurality of sensor units which are respectively configured in a corresponding one of the block-shaped units to sense a pressure;

a process unit configured to generate a control instruction for controlling the smart watch according to position information of the block-shaped unit where the sensor unit that had sensed the pressure is located.

11. The smart watch according to claim 1, wherein the smart watch further comprises:

an energy transformation unit configured to sense motion and transform the energy generated by the sensed motion into electrical energy and store the electric energy in the battery.

12. The smart watch according to claim 7, wherein the smart watch further comprises:

an energy transformation unit configured to sense motion and transform the energy generated by the sensed motion into electrical energy and store the electric energy in the battery.

* * * * *